US005253024A

United States Patent [19]

Okuda et al.

[11] Patent Number: 5,253,024

[45] Date of Patent: Oct. 12, 1993

[54] FIXING APPARATUS WITH RECTIFIER ELEMENT

[75] Inventors: Koichi Okuda, Tokyo; Yoji Tomoyuki, Yokohama; Toshio Miyamoto, Tokyo; Junji Araya, Yokohama; Yukihiro Ohzeki, Kashiwa; Masanobu Saito, Yokohama; Shunji Nakamura, Yokohama; Yasumasa Ohtsuka, Yokohama; Tatsunori Ishiyama, Yokohama; Katsuhiko Nishimura, Yokohama; Akira Hayakawa, Machida; Yasushi Sato, Kawasaki; Kimio Nakahata, Kawasaki, all of Japan

[73] Assignee: Canon Kabushiki Kaisha, Tokyo, Japan

[21] Appl. No.: 804,516

[22] Filed: Dec. 10, 1991

Related U.S. Application Data

[63] Continuation of Ser. No. 446,426, Dec. 5, 1989, abandoned.

[30] Foreign Application Priority Data

| | | | |
|---|---|---|---|
| Dec. 7, 1988 | [JP] | Japan | 63-307929 |
| Mar. 28, 1989 | [JP] | Japan | 1-73795 |
| Oct. 31, 1989 | [JP] | Japan | 1-285899 |
| Oct. 31, 1989 | [JP] | Japan | 1-285900 |

[51] Int. Cl.[5] ..... G03G 15/20

[52] U.S. Cl. ..... 355/282; 219/216; 355/285; 355/289

[58] Field of Search ..... 355/285, 289, 290, 282, 355/295; 29/216; 118/60

[56] References Cited

U.S. PATENT DOCUMENTS

| | | | |
|---|---|---|---|
| 4,466,732 | 8/1984 | Folkins | 355/251 |
| 4,616,917 | 10/1986 | Sakurai . | |
| 4,673,280 | 6/1987 | Milton | 250/325 X |

FOREIGN PATENT DOCUMENTS

| | | | |
|---|---|---|---|
| 59-34573 | 2/1984 | Japan . | |
| 0090874 | 5/1984 | Japan | 355/284 |
| 59-90874 | 5/1984 | Japan . | |
| 60-140280 | 7/1985 | Japan . | |
| 0052674 | 3/1986 | Japan | 355/282 |
| 0132973 | 6/1986 | Japan | 355/290 |
| 0142367 | 6/1988 | Japan | 355/282 |
| 0289572 | 11/1988 | Japan | 355/284 |

*Primary Examiner*—A. T. Grimley
*Assistant Examiner*—T. A. Dang
*Attorney, Agent, or Firm*—Fitzpatrick, Cella, Harper & Scinto

[57] ABSTRACT

The present invention relates to a fixing apparatus having a pair of rotary members for pinching and conveying a supporting material bearing a non-fixed toner image thereon, thereby fixing the non-fixed toner image on the supporting material and wherein a rectifier element is connected to at least one of the rotary members in a predetermined orientation, whereby the present invention prevent a toner offset that the toner on the supporting material is adhered to the rotary members.

24 Claims, 8 Drawing Sheets

FIXING APPARATUS WITH RECTIFIER ELEMENT

This application is a continuation of application Ser. No. 07/446,426 filed Dec. 5, 1989; now abandoned.

BACKGROUND OF THE INVENTION

1. Field of the Invention

The present invention relates to a fixing apparatus used with electrophotographic systems such as a copying machine, electrophotographic printer and the like and with image forming systems such as an electrostatic recording apparatus and the like, for fixing or fusing a non-fixed toner image formed on a recording sheet material, and more particularly, it relates to a fixing apparatus for fixing a non-fixed toner image onto a recording sheet material by pinching and conveying the recording sheet material bearing the non-fixed toner image thereon by means of a pair of rotary members.

2. Related Background Art

In the past, as fixing apparatuses used with electrophotographic systems or with image forming systems such as an electrostatic recording apparatus, a fixing apparatus of roller type comprising a fixing roller incorporating a heating source such as a halogen heater therein and a pressure roller urged against the fixing roller to be rotated therewith and having an outer elastic layer made of silicone rubber has generally been utilized. Such a fixing apparatus of roller type has widely been put in practical use, since it is better than other fixing apparatuses in view of stable conveyance of a recording sheet and/or good security against the firing due to the overheat of the heater.

However, in the above mentioned conventional fixing apparatus of roller type, there arose a problem that, since the non-fixed toner image directly contacted the outer surface of the roller, a portion of the non-fixed toner was transferred to the roller surface to cause a so-called offset phenomenon.

In general, the offset phenomena generated in the above-mentioned fixing apparatus are grouped into two, i.e., thermal offset (offset due to temperature) and electrostatic offset (offset due to electrostatics).

The former includes a low temperature offset wherein the temperature of the toner in the fixing apparatus is too low to be fixed onto the recording sheet, thus causing the offset, and a high temperature offset wherein the toner temperature in the apparatus is high sufficient to melt the toner to a liquid form, thus causing the offset. These offset phenomena can be avoided by properly determining the temperature of the fixing roller by means of a temperature controlling means such as a thermistor on the basis of the feature of the developer (toner), conveying speed of the recording sheet and roller pressure.

On the other hand, the latter, i.e., electrostatic offset may be caused by the fact that the charged toner on the recording sheet is transferred onto the fixing roller electrostatically. Since this offset phenomenon largely depends upon the kind of the recording sheet and circumferential condition, it is difficult to control the transfer of the toner (from the recording sheet to the fixing roller). Up to date, rather than performing the control for directly decreasing the electric field which may cause the electrostatic offset, the disadvantage due to the electrostatic offset, such as the jamming of the recording sheet which may be caused by the smudge of the recording sheet and/or fixing roller due to the offset toner has been partly eliminated by removing the offset toner transferred to the fixing roller by means of a cleaning means such as a felt pad or cleaning blade pressed against the fixing roller. Therefore, the electrostatic offset problem has not yet still been solved.

Further, as well as the provision of the cleaning means, there has been proposed a means for positively preventing the offset of the toner by forming the roller surface with toner-separable material or by applying the separating agent such as silicone oil to the roller surface. However, the electrostatic offset problem has not yet still been solved.

Furthermore, in order to reduce the toner offset, it is also known to float the fixing roller without grounding electrically (referred to as "floating condition" hereinafter). In the case where the fixing roller is electrically held in the floating condition, when a certain amount of toner is transferred or offset to the fixing roller, the fixing roller is charged to the same charge polarity as that of the charged toner, whereby the toner on the recording paper is repulsed from the fixing roller, thus reducing the toner offset.

However, if the fixing roller is electrically held in the floating condition, particularly in the low moisture circumstances, the fixing roller is charged to have a value of a few KV due to the friction with the recording paper, thus causing the discharging phenomenon, which may generate the electric noise leading to the erroneous operation of the image forming system.

SUMMARY OF THE INVENTION

An object of the present invention is to provide a fixing apparatus which can avoid the electrostatic offset of toner.

Another object of the present invention is to provide a fixing apparatus which can prevent the excessive charging of rotary members such as a fixing roller to minimize the electric noise, thus preventing the erroneous operation of an image forming system.

Other objects and features of the present invention will be apparent from the following descriptions in connection with the accompanying drawings.

DETAILED DESCRIPTION OF THE PREFERRED EMBODIMENT

Figure 1:
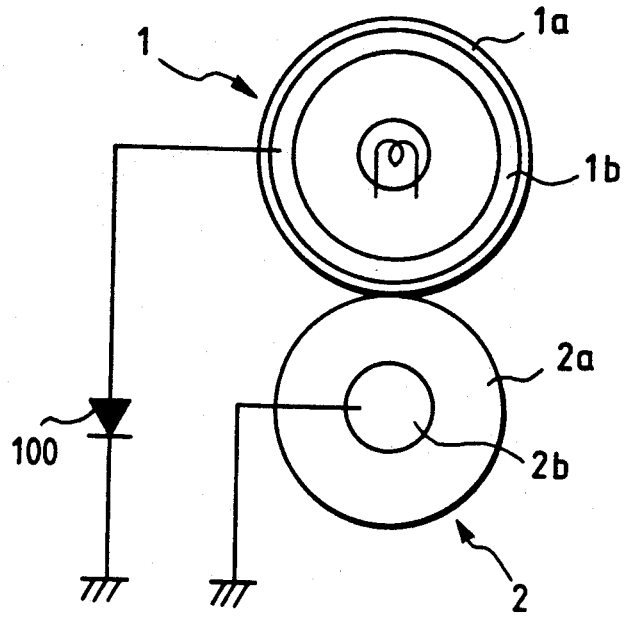
FIGS. 1 and 2 are schematic sectional views for explaining a fixing apparatus according to a preferred embodiment of the present invention.

The present invention will now be explained in connection with embodiments thereof with reference to the accompanying drawings.

First of all, a fixing apparatus to which the present invention is applicable will be explained with reference to FIG. 3.

The fixing apparatus F comprises a pair of rotary members (movable members), i.e., a fixing roller 1 and a pressure roller 2 pressed against the fixing roller and rotated together with the latter. Incidentally, in this embodiment, the fixing roller 1 contacts a non-fixed toner image formed on a recording sheet (image bearing sheet). Further, in the illustrated embodiment, while the rotary members are embodied as rollers, the rotary members are not limited to such rollers, but may comprise endless movable members such as endless belts.

The upper fixing roller 1 comprises a hollow core made of aluminium, iron and the like, and a cover layer covering an outer cylindrical surface of the core and made of material having good toner-separating ability, such as PTFE, PFA or silicone. Within the fixing roller, there is provided a heater h such as a harogen lamp by which the fixing roller is heated. The lower pressure roller 2 comprises a core made of iron, stainless steel and the like. An outer cylindrical surface of the core is coated by toner-separable elastomer such as silicone rubber, fluororubber and the like. The fixing roller 1 and the pressure roller 2 are urged against each other by an appropriate bias means such as a spring (not shown) and are rotated in directions shown by the arrows. A temperature sensing element 3 such as a thermistor is arranged to contact the surface of the fixing roller, which element can detect the surface temperature of the fixing roller 1. The energization of the heater h is controlled by a temperature adjusting circuit on the basis of the surface temperature detected by the temperature sensing element 3, whereby the surface temperature of the fixing roller 1 is automatically maintained in a predetermined fixing temperature.

The reference numeral 4 designates a separating pawl or claw for separating the recording sheet from the fixing roller 1. An edge of the free end of the separating pawl 4 is pressed against the surface of the fixing roller 1 at an appropriate pressure. The reference numeral 5 designates a cleaner such as a felt urged against the surface of the fixing roller 1, which cleaner can sweep away the toner and/or paper powder adhered to the surface of the fixing roller 1. The reference numerals 6 and 7 designate an inlet guide and an outlet guide, respectively, which can guide the recording sheet and are attached to a frame of the fixing apparatus F.

A toner image formed on a surface of a photosensitive drum (image bearing member) is transferred onto the recording sheet P by means of a transfer charger (transfer charger means). Thereafter, the recording sheet is conveyed or fed through the inlet guide 6 to the fixing apparatus F, where the recording sheet is introduced into the nip between the fixing roller 1 and the pressure roller 2 which are pressed against each other and are rotated altogether. While passing through the nip, the non-fixed toner image ta on the recording sheet P is thermally fixed on the recording sheet P as a permanent fixed image tb by the heat from the fixing roller 1 and the pressure between the rollers 1 and 2.

The recording sheet P which has passed through the nip between the rollers 1, 2 and on which the images has been fixed is separated, at its leading edge, from the fixing roller 1 by means of the separating pawl 4, and then is fed to a sheet path (not shown) through the outlet guide 7. In this way, the recording sheet is ejected onto an ejector tray.

Figure 3:
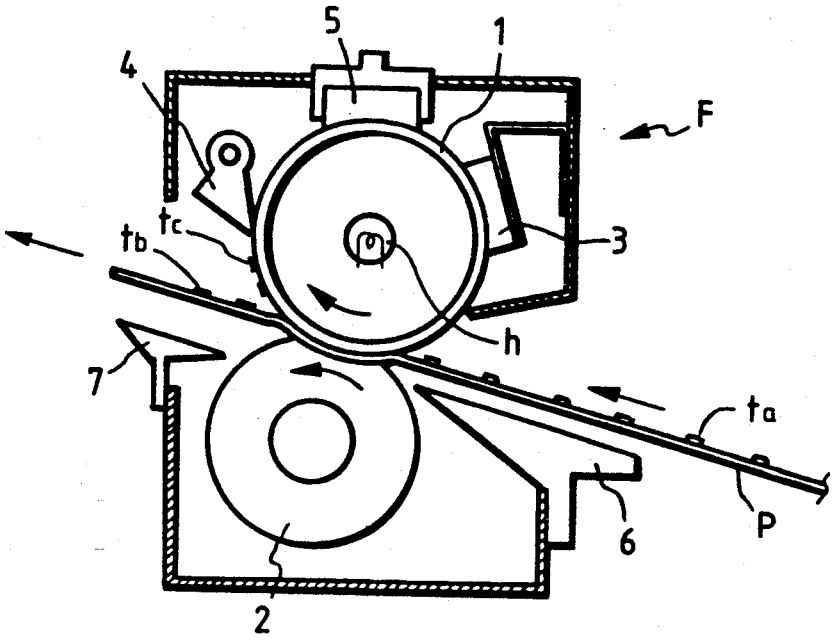
FIG. 3 is a sectional view of a fixing apparatus to which the present invention is applicable.

Incidentally, in FIG. 3, offset toner transferred from the recording sheet P to the fixing roller 1 and adhered to the surface of the fixing roller due to the offset phenomenon is shown as tc. The present invention aims to minimize an amount of such offset toner.

Next, a first embodiment of the present invention will be explained with reference to FIGS. 1 and 2. FIG. 1 shows an example that the toner as the developer forming the non-fixed toner image on the recording sheet to be fed to the fixing apparatus which is charged negatively (minus charge), whereas, FIG. 2 shows an example that such toner is charged positively (plus charge).

The fixing roller 1 comprises a hollow core 1*b* and a toner-separable coating layer 1*a* surrounding an outer surface of the core. The pressure roller 2 comprises a central core 2*b* and an outer elastic layer 2*a*.

Figure 2:
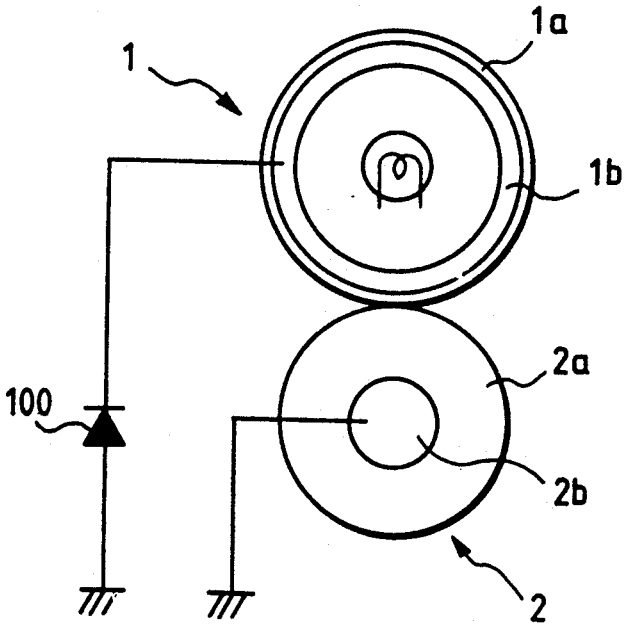

In FIGS. 1 and 2, the core 1*b* of the fixing roller 1 is grounded through a diode 100 acting as a rectifier element, a connection direction of which is so selected that the fixing roller can hold the electric charge having the same polarity as that of the toner, both in FIG. 1 and FIG. 2.

Figure 4:
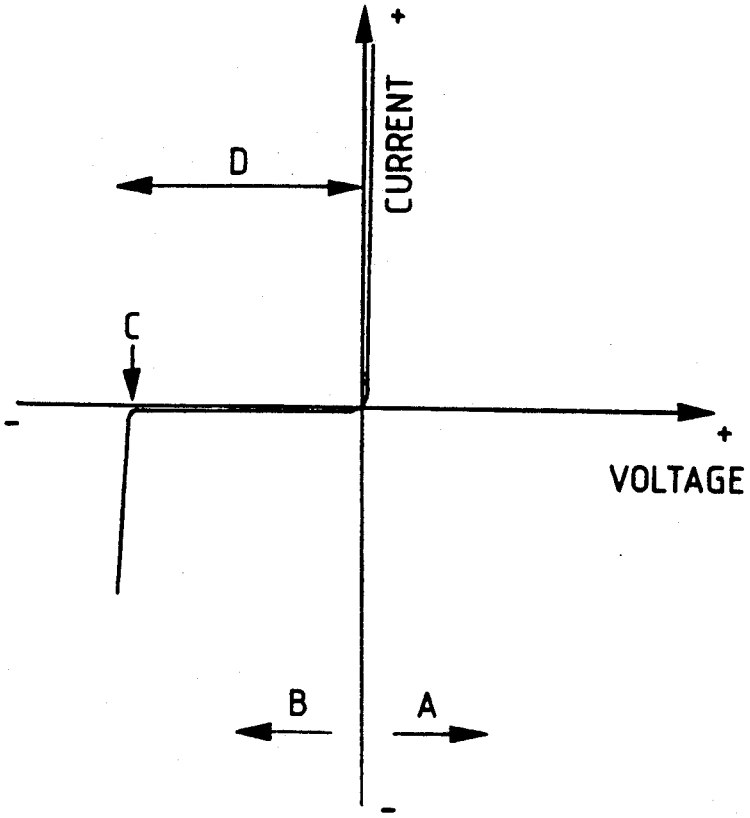
FIG. 4 is a graph showing the relation between current and voltage of a diode.

Now, FIG. 4 shows a characteristic curve of the current and voltage of the diode 100. As seen from FIG. 4, in an area A where the diode 100 is connected in a normal direction, however much the current may flow, the voltage does not increase. To the contrary, in an area B where the diode 100 is connected in a reverse direction, only little current flow causes the voltage to increase up to the voltage yielding point C, and then, if a further current flows, the voltage will not increase as much.

In consideration of such characteristic of the diode, the diode 100 is connected to the fixing roller 1 in the connection direction as shown in FIG. 1 and FIG. 2. In this case, even when only a little toner is offset or transferred to the fixing roller 1, since the diode 100 is connected oppose to the charge polarity of the toner, the potential of the fixing roller 1 is changed to have the same charge polarity as that of the toner, thus creating the repulsion force between the fixing roller and the toner, whereby the offset of the toner can be reduced.

Further, in the low moisture circumstances, if the fixing roller 1 is charged by other causes than the offset of the toner, for example, if the fixing roller 1 is charged to have the charge polarity opposite to that of the toner, the fixing roller becomes substantially in the grounded condition. Whereas, even if the fixing roller is charged to have the same charge polarity as that of the toner, the voltage does not increase more than the voltage yielding point C (FIG. 4). Accordingly, it is not feared that the fixing roller is charged up excessively.

By the way, it was found that the less the electrostatic capacity of the diode, the more the amount of the offset toner could be reduced. The reason may be that, for example, when the same amount of toner is offset or transferred to the fixing roller 1, the smaller the connection capacity between the fixing roller and a chassiss, the greater the potential fluctuation of the fixing roller, and thus, the greater the electric field for repulsion against the toner on the recording sheet. From the test results, it was found that the electrostatic capacity of the diode required to prevent the offset of the toner was preferably 100 pF or less.

Now, the above-mentioned "electrostatic capacity" corresponds to an electrostatic capacity when the reverse bias in an area D, i.e., the reverse bias having a value below the voltage yielding point C in the reverse direction (reverse direction voltage yielding point) is applied to the diode 100.

Further, it was found that a diode having the reverse direction voltage yielding point C (FIG. 4) of 50 V or more was desirable to prevent the toner offset. The reason may be that, if the reverse direction yielding voltage of the diode 100 is small, when the toner is offset, since the potential of the fixing roller cannot reach above the reverse direction yielding voltage, the electric field sufficient to repulse the toner on the recording sheet cannot be obtained.

Figure 5:
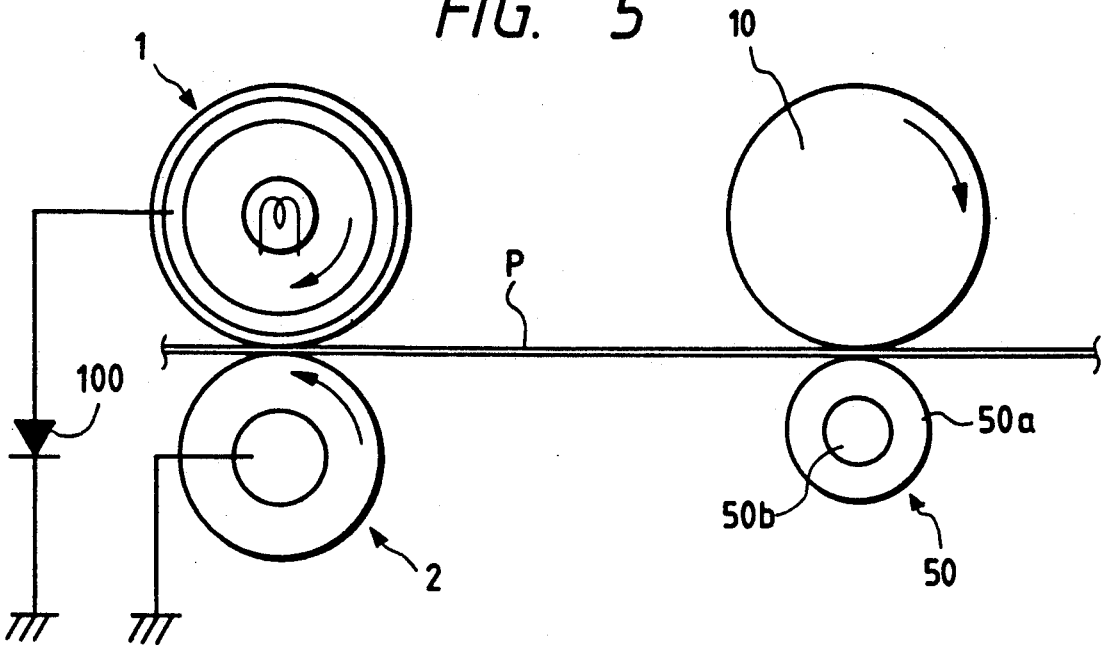
FIG. 5 is a schematic sectional view for explaining an image forming system having a transfer roller and incorporating the fixing apparatus of FIG. 1.

FIG. 5 shows an example that the present invention is applied to an image forming system including a transfer means comprising a transfer member such as a transfer roller (transfer rotary member) for transferring the non-fixed toner image formed on the image bearing member onto the recording sheet.

The transfer roller 50 acting as the transfer member comprises a metallic core 50*b* made of iron, stainless steel and the like and an outer conductive elastomer layer 50*a*. The transfer roller is subjected to a bias voltage from an appropriate power source (not shown). Unlike to a transfer charger not having a transfer roller, since the transfer roller 50 can apply the bias voltage to the recording sheet by directly contacting the latter, it has an advantage that the erroneous or poor transfer does not occur even in the high moisture circumstances. However, it was found that the conventional fixing apparatus including the fixing roller had a disadvantage that, in the high moisture circumstances, the transferring current flows to the fixing roller 1 through the transfer paper (recording sheet) P which is wet to reduce its resistance, whereby the surface of the fixing roller 1 is charged to have the same polarity as that of the transfer roller 50, thus attracting the toner toward the fixing roller to offset the toner.

The embodiment shown in FIG. 5 aims to eliminate such disadvantage. This example shows the case where the toner having the negative polarity.

For example, regarding arrangement shown in FIG. 5 having the maximum paper passing width of 220 mm and the transferring bias of +500 V, in comparison with the amount of the offset toner generated in the apparatus wherein the fixing roller 1 is grounded by the diode 100 having the electrostatic capacity of 20 pF and reverse direction yielding voltage of 600 V, and the amount of the offset toner generated in the apparatus wherein the fixing roller is directly connected to ground without such diode, in the high moisture circumstances, the amount of the offset toner generated in the apparatus having the diode could be reduced to 1/100 of that generated in the apparatus having the fixing roller directly connected to the ground.

Next, a second embodiment of the present invention will be explained. This embodiment is realized to reduce the electrostatic offset which may be caused by the fact that the transferring charge applied to the back of the recording sheet and having the charge polarity opposite to that of the toner leaks through the pressure roller.

Figure 6:
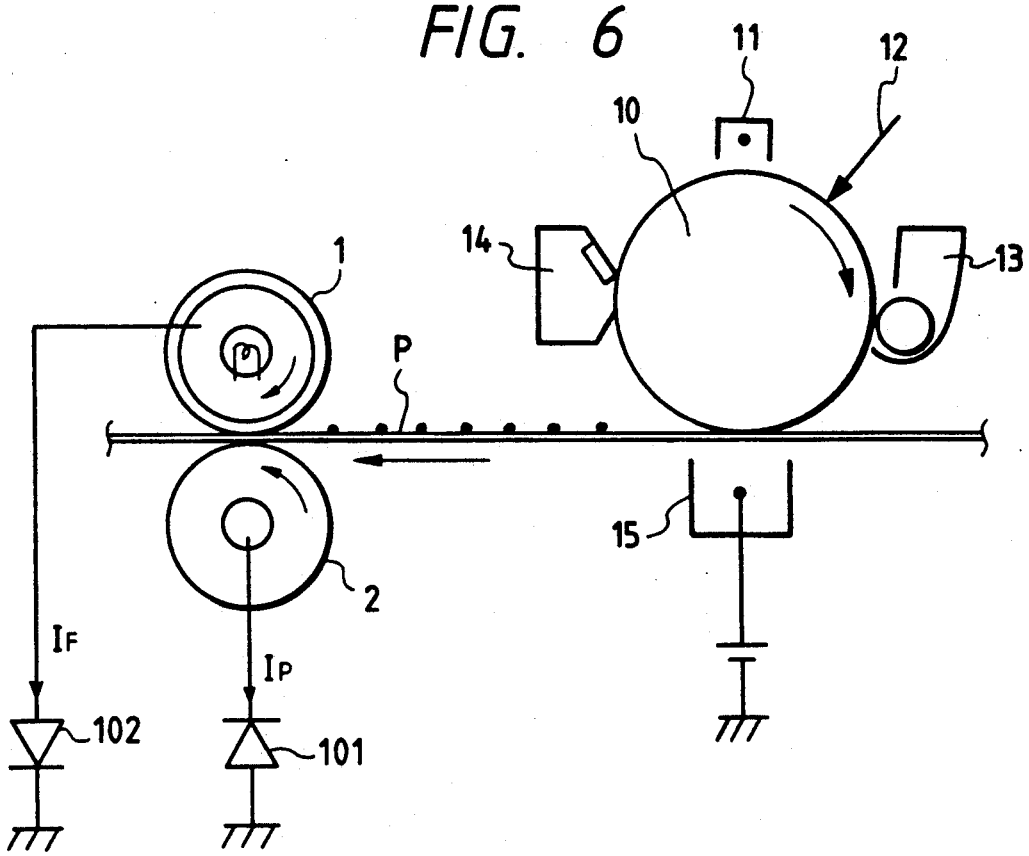
FIGS. 6, 8 and 9 are schematic sectional views of main portions of an image forming system incorporating a fixing apparatus according to a second embodiment of the present invention.

FIG. 6 is a sectional view showing a main portion of the image forming system incorporating a fixing apparatus according to the second embodiment.

In FIG. 6, a fixing roller 1 comprises a hollow metallic core made of aluminium, iron and the like, an outer surface of which is coated by good toner-separable material or tube such as PTFE, PFA or silicone rubber, and a heating source such as a harogen lamp arranged within the core. The outer surface of the fixing roller is maintained to a given temperature by means of an appropriate temperature controlling means (not shown).

A pressure roller 2 pressed against the fixing roller and driven by the rotation of the fixing roller comprises a central metallic core made of iron, stainless steel and the like, and an outer elastic layer made of silicone rubber of fluororubber.

The core of the pressure roller 2 is connected to GND (earth) through a diode 101 acting as a rectifier element in such a manner that the electric charge having the charge polarity opposite to that of the non-fixed toner image is held on the pressure roller 2; whereas, the core of the fixing roller 1 is also connected to GND through a diode 102 acting as a rectifier element in such a manner that the electric charge having the same charge polarity as that of the non-fixed toner image is held on the fixing roller 1. In this embodiment, the example that the toner having the negative (minus) charge polarity is used is shown.

On the other hand, a latent image is formed on a photosensitive drum 10 acting as an image bearing member, by the charge from a charger 11 and the illumination 11 of light information according to image information. The latent image is developed by the developer (toner) in a developing device 13 to form a toner image. Incidentally, the reference numeral 14 designates a cleaner for cleaning the photosensitive drum 10.

The toner image formed on the surface of the photosensitive drum 10 is transferred onto the recording sheet P by applying the charge having the charge polarity (in this case, positive or plus polarity) opposite to that of the toner to the back of the recording sheet by means of a transfer charger means 15. The recording sheet P on which the toner image has been transferred is introduced into the nip between the fixing roller 1 and the pressure roller 2, where the toner image is thermally fixed onto the recording sheet P.

Normally, in the image forming system including a transferring process, the non-fixed toner image transferred from the image bearing member to the recording sheet by means of the transfer charger means is strongly held on the recording sheet by the charge of the toner and the transferring charge having the polarity opposite to that of the toner and applied to the back of the recording sheet.

From the test results, it was found that the electrostatic toner offset was caused by the fact that the transferring charge having the charge polarity opposite to that of the toner and applied to the back of the recording sheet to electrostatically hold the toner on the recording sheet leaks in the fixing apparatus through the pressure roller 2 contacting with the back of the recording sheet.

Particularly, the electrostatic offset occurs noticeably in the case where a recording sheet such as an OHP transparent film of sandwich structure obtained by coating middle-resistive material having a surface resistance of about $10^9$–$10^{12}$ Ω on both surfaces of dielectric film which has been widely utilized is used, rather than a plain paper.

In such an OHP film, when it is separated from the photosensitive drum, the reverse charge $-Q'$ depending upon the transferring charge $+Q$ applied in the transfer charging process is applied to a recording surface (surface on which the toner image is transferred) of the OHP film by the separating discharge. According to the test results, the reverse charge $Q'$ was about 50–90% of the transferring charge Q. Accordingly, it is considered that, if the transferring charge leaks through the pressure roller, since the separating charge remains on the recording surface of the OHP film, the electrostatic force for holding the toner is reduced quickly, thus causing the toner offset.

Figure 7:
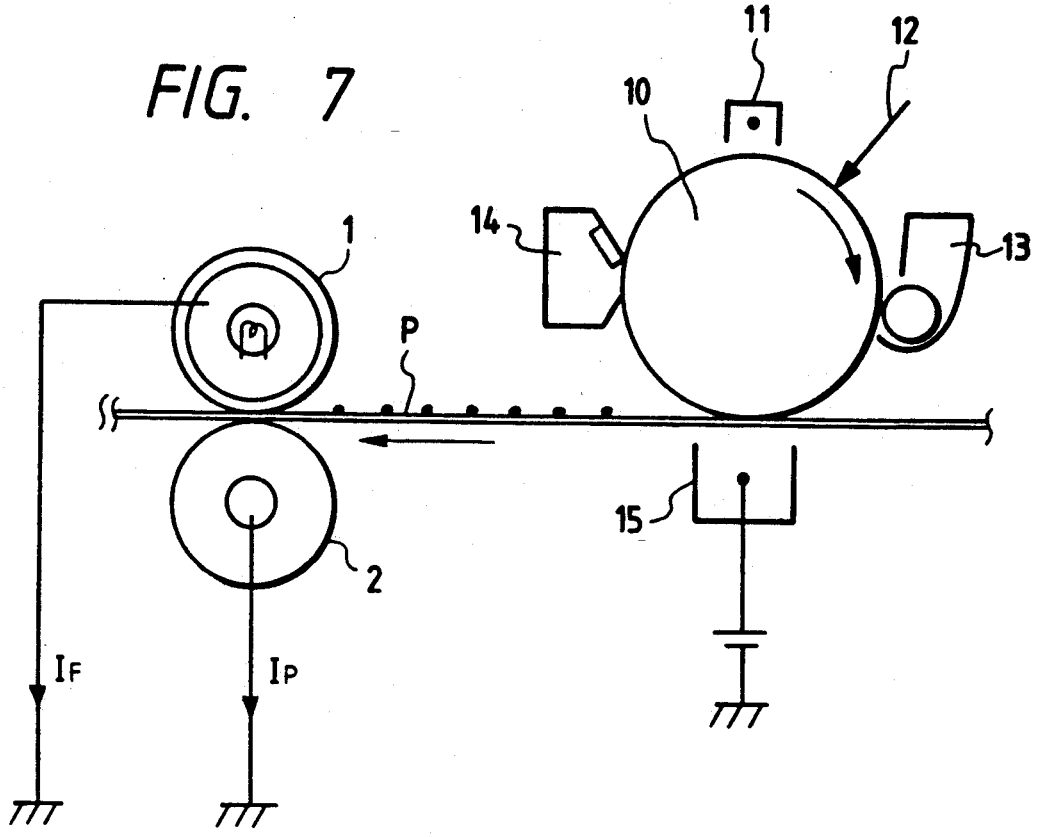
FIG. 7 is a schematic sectional view of a main portion of an image forming system incorporating a fixing apparatus comparative to the embodiment of FIG. 6.

For example, as shown in FIG. 7, in the fixing apparatus wherein both of the cores of the pressure roller 2 and the fixing roller 1 are directly connected to the earth, tests were effected by using the OHP sheet (having the surface resistance of about $10^{12}\ \Omega$) sold by 3M corp. in the United States to examine the relation between the offset and the leak current during passing through the OHP sheet with respect to the pressure rollers having various resistances. The test results is shown in the following Table 1.

TABLE 1

| Resistance of Pressure Roller | $10^{10}\ \Omega$ | $10^{11}\ \Omega$ | $10^{12}\ \Omega$ | $10^{13}\ \Omega$ | $10^{14}\ \Omega$ |
|---|---|---|---|---|---|
| Current Ip of Pressure Roller | +300 nA | +100 nA | +5 nA | 0 nA | 0 nA |
| Current $I_F$ of Fixing Roller | −50 nA | −20 nA | −2 nA | 0 nA | 0 nA |
| Offset | X | X | Δ | Δ | X |

The resistance of the pressure roller was obtained in such a manner that a metallic roller made of stainless steel was pressed against the fixing roller to create the nip of about 2–3 mm and the resistance between the core of the pressure roller and the metallic roller was measured by a resistance meter. Further, the fixing roller was formed from a cylindrical body made of aluminium and coated by an insulating PFA tube having a thickness of about 30 μm therearound.

If the resistance of the pressure roller becomes $10^{12}\ \Omega$ or less, the transferring charge ⊕ on the back of the recording sheet is beginning to flow as the leak current to the GND through the pressure roller. As the resistance of the pressure roller decreases, the leak current increases.

At the same time, the charge ⊖ having the same polarity as that of the toner and being applied to the recording surface of the OHP sheet loses its holding force, and, thus, the ⊖ charge is beginning to leak onto the surface of the fixing roller, whereby the current flowing from the GND to the core of the fixing roller can be measured. If the resistance of the pressure roller decreases below $10^{12}\ \Omega$, the amount of the toner offset decreases more and more. On the other hand, if the resistance of the pressure roller is above $10^{13}\ \Omega$, the leak current cannot be measured, but the toner offset does not cease.

Generally, in the fixing apparatus of roller type, since the pressure roller is urged against the fixing roller at a pressure of few Kg–ten Kg or more, in some cases, the surface of the pressure roller is charged to have the same polarity as that of the toner by the frictional charging according to the kind of the recording sheet, which results in the electrostatic offset. This phenomenon occurs noticeably when the toner is charged to the minus charge polarity.

Accordingly, in order to prevent the charge-up of the frictional charging between the roller and the recording sheet, it is desirable to use the pressure roller having the resistance of $10^{12}\ \Omega$ or less.

Further, when the pressure roller is maintained in the floating condition without grounding it, even if the resistance of the pressure roller is below $10^{12}\ \Omega$, the leak of the transferring charge can be reduced.

Due to the reduction of the transferring charge, even if the resistance of the pressure roller is below $10^{12}\ \Omega$, the offset of the toner can be reduced when the pressure roller is in the floating condition.

In this way, although it is possible to reduce the electrostatic offset by using the pressure roller having the low resistance and by keeping the core of the pressure roller in the floating condition, if the continuous printing operation is effected or in the low moisture circumstances, it is feared that the transferring charge leaks to surrounding conductors by the charge-up of the pressure roller, thus causing erroneous electrical operation of the image forming system.

Accordingly, in an embodiment shown in FIG. 6, the diode 102 acting as the rectifier element is interposed between the fixing roller 1 and the ground in such a manner that the charge having the same charge polarity as that of the toner is maintained, and the diode 101 acting as the rectifier element is interposed between the pressure roller and the earth in such a manner that the charge having the charge polarity opposite to that of the toner is maintained.

With this arrangement, it is possible to prevent the transferring charge ⊕ on the back of the recording sheet from leaking to the GND by the rectifier function of the diode 101, and to make the potential of the fixing roller to the same charge polarity as that of the toner by the diode 102 and by the ⊕ charge having the same polarity as that of the toner and applied to the recording surface of the OHP sheet, whereby the repulsion force for repulsing the toner on the OHP sheet acts on the surface of the fixing roller. In addition, since when the diode is connected in the reverse direction the voltage does almost not increase above the yielding voltage, by selecting any diode having a proper yielding voltage, it is possible to prevent the erroneous electrical operation of the image forming system due to the discharge in consequence of the charge-up of the pressure roller.

The following Table 2 shows the leak current while passing through the OHP sheet, offset, potential of the core of the fixing roller, and potential of the core of the pressure roller, when the diodes having the yielding voltage of 1 KV are used in this embodiment.

TABLE 2

| Resistance of Pressure Roller | $10^{10}\ \Omega$ | $10^{11}\ \Omega$ | $10^{12}\ \Omega$ |
|---|---|---|---|
| Current Ip of Pressure Roller | 0 nA | 0 nA | 0 nA |
| Potential of Pressure Roller | +800 V | +800 V | +800 V |
| Current $I_F$ of Fixing Roller | 0 nA | 0 nA | 0 nA |
| Potential of Fixing Roller | −50 V | −50 V | −50 V |
| Offset | ○ | ○ | ○ |

The fixing roller 1 having a diameter of 20 mm and made of an aluminium tube coated by a PFA tube having a thickness of 30 μm was used. The pressure roller 2 having a diameter of 16 mm and having various resistances according to the amount of the resistance controlling material was urged against the fixing roller at a total pressure of about 7 Kg. The transferring current of 1.5 μA was applied to the OHP sheet moving at a speed of 24 mm/sec.

In the pressure roller having the resistance of $10^{10}$–$10^{12}$ Ω, it was found that the potential of the core of the pressure roller was maintained at about +800 V and the potential of the core of the fixing roller was maintained at about −50 V and the currents flowing from both rollers to the GND were few below 1 nA, and the electrostatic offset regarding the OHP sheet did not occur.

Further, in order to positively prevent the excessive charge-up of each roller, it is desirable to use the diode having the voltage yielding point of 3 KV or less, preferably 2 KV or less.

Figure 8:
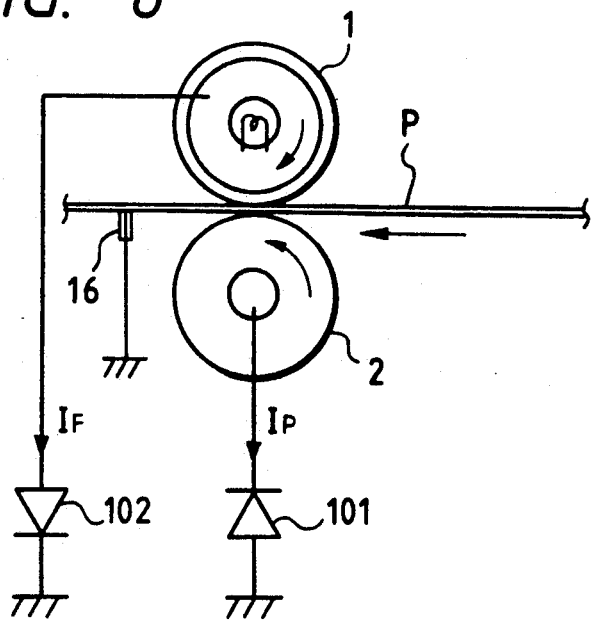

FIG. 8 is a sectional view of a fixing apparatus according to an alteration of the aforementioned embodiment. In this example, in order to prevent the electrostatic attraction between the recording sheets thereby improving the stacking ability of the recording sheets, a charge removing brush 16 contacting the back of the recording sheet and connected to the GND is arranged at an outlet of the fixing apparatus. The pressure roller has the resistance of $10^{10}$–$10^{12}$ Ω, as in the previous embodiment. In this embodiment, when the back of the recording sheet contacts with the charge removing brush 16, the current of 100–200 nA flows through the charge removing brush in a direction from the OHP sheet to the GND, thus removing the charge.

By removing the charge from the back of the recording sheet by means of the charge removing brush, the holding force given by the electrostatic force of the charge having the same polarity as that of the toner remaining on the recording surface of the OHP sheet decreases quickly. In this case, if the core of the fixing roller 1 was directly connected to the earth, the current of 10–20 nA flowed in a direction from the GND to the core of the fixing roller, and, thus, the toner offset occured. However, in the illustrated embodiment, since the diode 102 is interposed between the fixing roller and the GND, such current does not flow, but the potential of the core of the fixing roller 1 is increased up to about −600 V, whereby the non-fixed toner image having ⊖ charge on the OHP sheet is subjected to the electrostatic force directing toward the back of the OHP sheet, thus preventing the occurrence of the toner offset.

Figure 9:
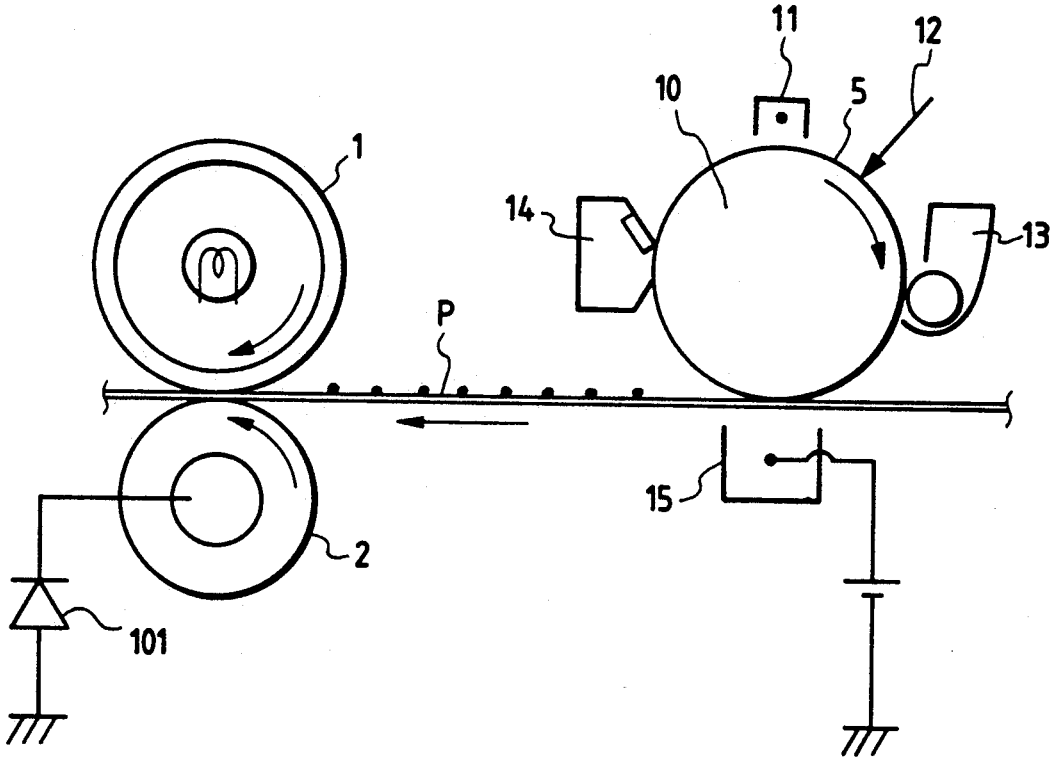

By the way, in the aforementioned embodiment shown in FIGS. 6 and 8, when the electrostatic offset is caused only by the leak of the transferring charge applied to the back of the recording sheet, it is not necessary to connect the rectifier element to the fixing roller, but, it should be noted that, as shown in FIG. 9, the diode acting as the rectifier element may be connected to the pressure roller alone in such a manner that the charge having the same polarity as that of the transferring charge is maintained, thus preventing the leak of the transferring charge. Further, according to FIG. 9, even when the ⊖ charge having the polarity opposite to that of the transferring charge is generated on the pressure roller due to the friction between the pressure roller and the recording sheet, it is possible to leak the ⊖ charge to the GND because of the connection direction of the diode, thereby preventing the reduction (due to the friction charge) of the holding force for holding the toner onto the recording sheet in the contacting area between the recording sheet and the pressure roller.

Incidentally, in the aforementioned embodiment shown in FIGS. 6 and 8, while examples that the charge polarity of the toner is the negative or minus polarity and that the transferring charge has the positive or plus polarity, respectively, were explained, when the toner has the positive polarity and the transferring charge has the negative polarity, the diodes may be connected in reverse directions opposite to those in the aforementioned embodiment. Also in this case, the same technical effect can be obtained.

Next, a third embodiment of the present invention will be explained. This embodiment is realized to minimize the electrostatic offset which may be caused when the roller surface is charged by the friction charge between the roller and the recording sheet.

Figure 10:
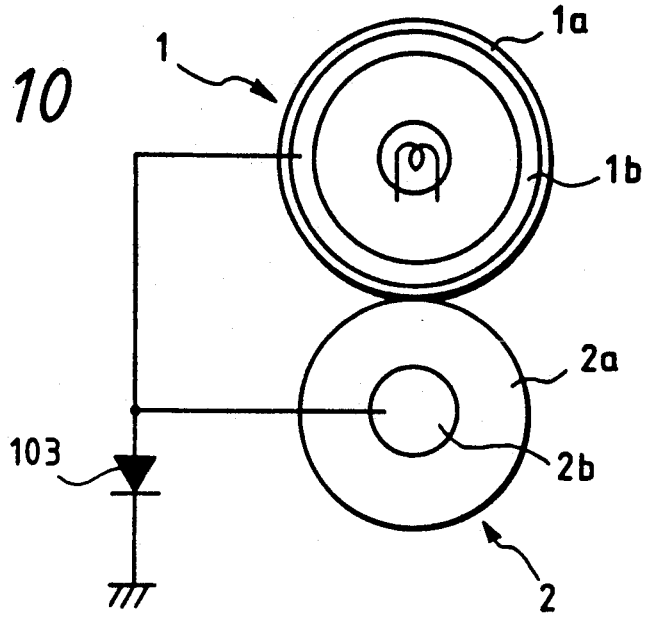
FIGS. 10 and 11 are schematic sectional views of a fixing apparatus according to a third embodiment of the present invention.

In FIG. 10, a fixing roller 1 comprises a hollow metallic core **1*b* made of aluminium, iron and the like, an outer surface of which is coated by a toner separable and heat-durable resin layer 1*a* made of PTFE or PFA. A pressure roller 2 urged against the fixing roller 1 comprises a central metallic core 2*b* made of iron, stainless steel and the like, and an outer toner-separable elastic layer 2*a* made of silicone rubber, fluororubber and the like. The core 1*b* of the fixing roller 1 is electrically connected to the core 2*b* of the pressure roller 2, and these cores are connected to the earth through a rectifier element 103** in a normal connection direction.

With this arrangement, it is assumed that when the recording paper (recording sheet) passes through the nip between these rollers the pressure roller 2 is charged to have the minus charge by the strong friction between the pressure roller and the recording paper. In this case, the surface of the fixing roller 1 will be charged to have weak plus charge. Since the rectifier element is connected as shown in FIG. 10, the minus charge stored in the pressure roller 2 cannot escape to the ground (GND), and, thus, is accumulated in the core **2*b* of the pressure roller 2, with the result that the potential of the core 1*b* of the fixing roller 1 is changed to the minus charge. Consequently, the potential of the outer surface of the fixing roller 1** is also changed to the minus charge, whereby the repulsion force is generated between the fixing roller and the toner having the minus charge, thus preventing the toner offset.

Figure 11:
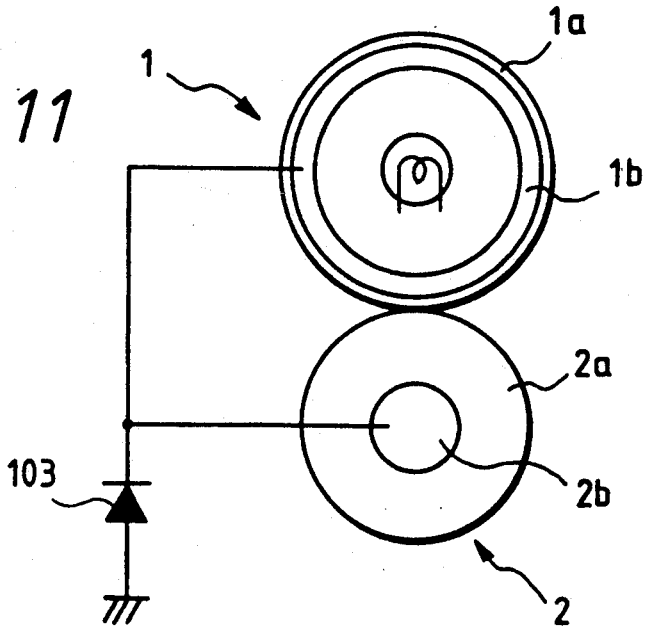

While the example that the toner having the minus charge is used was explained, as to the toner having the plus charge, as shown in FIG. 11, only the connection direction of the rectifier element 103 may be reversed. By connecting the rectifier element 103 in the reverse direction, the minus charge stored in the pressure roller 2 escapes to the ground; whereas, the surface of the fixing roller 1 is charged to the plus charge. Accordingly, the repulsion force is generated between the toner and the fixing roller, thus preventing the toner offset.

Now, the test results effected by using the fixing apparatus according to the illustrated embodiment will be explained.

The test conditions was as follows.

The fixing roller 1 comprising the core **1*b* having an outer diameter of 20 mm and a wall thickness of 2 mm and coated by the resin tube layer 1*a* made of PFA and having a thickness of 30 microns, and the pressure roller 2 comprising the core 2*b* having an outer diameter of 10 mm and the outer elastic layer 2*a*** made of LTV silicone rubber and having a wall thickness of 3 mm were used. Coating lengths (longitudinal lengths) of the PFA resin layer and silicone rubber layer were 226 mm and 222 mm, respectively. The cores of these two rollers were electrically connected to each other and were also connected to the earth through a diode DSA-1A4 manufactured by HITACHI SEISAKUSHO Co., Ltd. (Japan), as shown in FIG. 10.

Further, the rollers were urged against each other to form a nip having a width (length in a circumferential direction) of 2 mm and the OHP sheet was passed through the nip. The toner having the minus charge was used.

As a result, the surface of the pressure roller 2 was frictionally charged to −2000 V, and this charge was supplied to the core 1*b* of the fixing roller 1 to charge the core 1*b* to have a value of −750 V, with the result that the surface of the fixing roller 1 was charged to −250 V to generate the repulsion force between the toner and the fixing roller, whereby the toner offset was prevented.

Incidentally, it is preferable that the rectifier element here used has the yielding voltage of 50 V-500 V, because if the yielding voltage of the rectifier element is below 50 V it is impossible to apply the adequate charge to the fixing roller and to maintain such charge in the fixing roller, whereas if the yielding voltage is above 500 V the discharge will be generated in the low moisture circumstances, thus creating the electric noise which leads to the erroneous operation of the image forming system.

Next, alterations or deformations of the apparatuses shown in FIGS. 10 and 11 will be explained with reference to FIGS. 12 and 13. Incidentally, the same constructural elements as those in FIGS. 10, 11 will be designated by the same reference numerals as those used in FIGS. 10, 11, and the detailed description thereof will be omitted.

Figure 12:
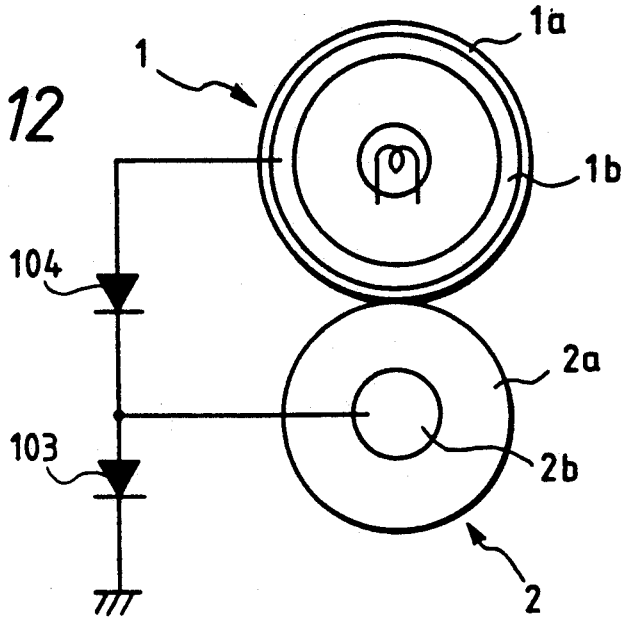
FIGS. 12 and 13 are schematic sectional views showing alterations of the fixing apparatuses of FIGS. 10 and 11.

FIG. 12 shows a fixing apparatus used with the toner having the minus charge polarity. In comparison with FIG. 10, in this embodiment, since the fixing roller 1 is connected to the pressure roller 2 through a rectifier element 104 so that the fixing roller is connected in the normal direction with respect to the pressure roller, the core 1*b* of the fixing roller 1 is charged to the minus charge more strongly.

The potentials of the cores of the fixing roller 1 and the pressure roller 2 were compared between the apparatuses shown in FIGS. 10 and 12 using the same roller pair as shown in the aforementioned test. As a result, in the apparatus shown in FIG. 10, the potentials of the cores 1*b*, 2*b* of two rollers were the same and had a value of −750 V. On the other hand, in the apparatus shown in FIG. 12, the potential of the core 1*b* of the fixing roller 1 was −950 V, whereas the potential of the core 2*b* of the pressure roller 2 was −650 V. In this way, by lowering the potential of the core of the fixing roller lower than that of the pressure roller, the surface of the fixing roller was more strongly charged negatively to have a value of −4000 V, thereby increasing the repulsion force against the toner to improve the offset preventing effect.

Figure 13:
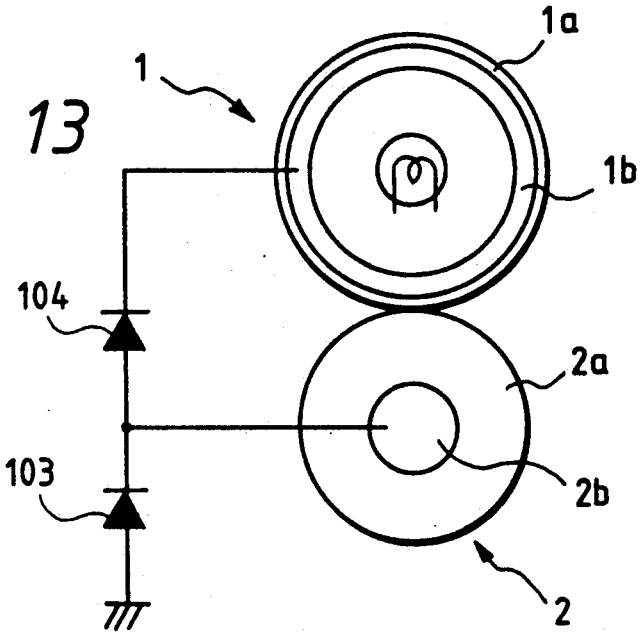

FIG. 13 shows a fixing apparatus used with the toner having the plus charge polarity. In this example, the rectifier element 104 is connected so that the plus charge can be easily stored in the core 1*b* of the fixing roller 1. Also in the embodiment shown in FIG. 13, the same technical effect as mentioned above was obtained.

Next, a further alterations of the apparatuses of FIGS. 12, 13 will be explained with reference to FIGS. 14 and 15. Incidentally, the same constructural elements as those in the aforementioned embodiments will be designated by the same reference numerals as those used in the aforementioned embodiments, and the detailed description thereof will be omitted.

Figure 14:
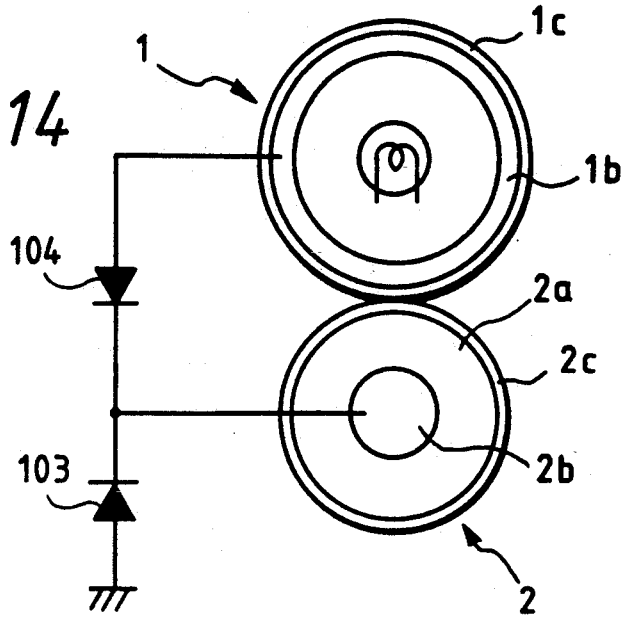
FIGS. 14 and 15 are schematic sectional views showing further alterations of the fixing apparatus of FIGS. 12 and 13.
Figure 15:
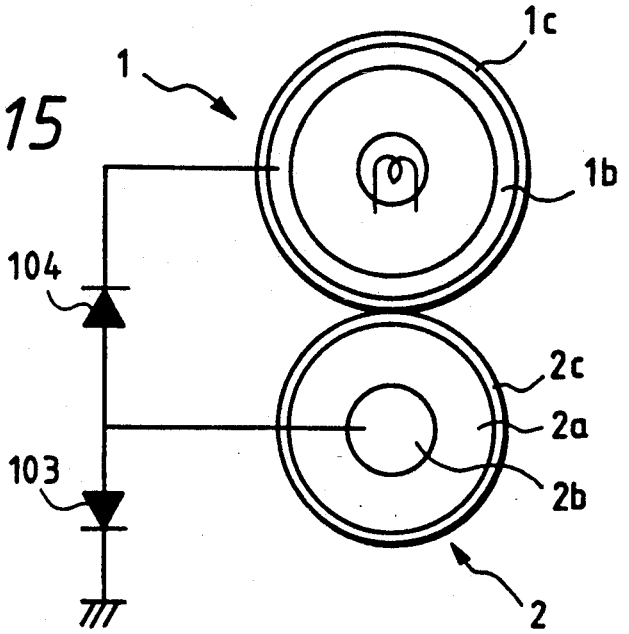

In the embodiments shown in FIGS. 10 to 13, while the material of the surface of the fixing roller 1 was fluororesin such as PFA and the material of the surface of the pressure roller 2 was silicone rubber, in the embodiments shown in FIGS. 14 and 15, these surface materials are reversed. That is to say, the material of the surface of the fixing roller 1 is constituted by a thin elastic layer 1*c* made of silicone rubber, and the material of the surface of the pressure roller 2 is constituted by a fluororesin layer 2*c* such as PFA. In particular, as an example, the pressure roller 2 comprises a core 2*b* and a silicone rubber layer 2*a*, and further includes an outer PFA tube 2*c* surrounding the silicone rubber layer.

By constituting the surface of the fixing roller 1 with the elastic material in this way, the fixing ability is increased, and the overpressure to the image is prevented, thus obtaining a good image.

FIG. 14 shows the embodiment when the toner having the minus charge polarity. In this embodiment, since the surface of the fixing roller 1 is covered by the silicone rubber, the surface is apt to be charged to the minus charge polarity. Accordingly, the rectifier element 104 is connected in the normal connection direction so that the potential of the core 1*b* charged by the charge generated on the surface of the fixing roller is held to the more minus charged condition.

In this embodiment, the potential of the surface of the fixing roller 1 becomes −2 KV to generate a strong repulsion force against the toner having the minus charge, thus preventing the toner offset. Incidentally, in this case, the surface of the pressure roller 2 is charged to +250 V, and the rectifier element 103 is connected in such a manner that the plus charge in the core 2*b* cannot be easily escape to the ground. In this way, since an attracting force for attracting the toner toward the pressure roller from the back of the recording sheet, the offset preventing effect is still improved.

FIG. 15 shows the embodiment when the toner having the plus charge polarity. In this example, the offset is prevented by designing that the plus charge is apt to be stored in the core 1*b* of the fixing roller 1 and the minus charge is apt to be stored in the core 2*b* of the pressure roller 2.

As mentioned above, according to this embodiment, since the fixing roller and the pressure roller are connected to each other and are also grounded earth through the rectifier element so that the charge having the same polarity as that of the toner can be maintained, even if the surface of the fixing roller is charged to the charge polarity opposite to that of the toner or developer, the offset can be prevented, and, since the rollers are connected to the earth through the rectifier element, the electric noise due to the discharge can be avoided, thus preventing the erroneous operation of the image forming system.

As mentioned above, according to the present invention, by connecting the rectifier element to the fixing rotary member such as roller, belt, endless sheet and the like in consideration of the connection direction thereof properly, the electrostatic toner offset can be prevented. Further, the electric noise generated by the excessive charging of the fixing rotary member can also be avoided, thus preventing the image forming system from operating erroneously due to the electric noise.

We claim:

1. A fixing apparatus comprising:

a fixing member having a voltage produced primarily by frictional contact, said fixing member contacting a non-fixed toner image having an electrical charge;

a pressure member for pinching therebetween and conveying a supporting material bearing the non-fixed toner image thereon, cooperating with said fixing member to thereby fix the non-fixed toner image on said supporting material; and a diode means connected between said fixing member and a ground for maintaining the voltage produced by the frictional contact of said fixing member at a polarity same as the non-fixed image without generating a voltage of polarity reverse thereto.

2. A fixing apparatus according to claim 1, wherein an electrostatic capacity of said diode is no greater than 100 pF.

3. A fixing apparatus according to claim 1, wherein yield voltage of said diode is at least 50 V.

4. A fixing apparatus according to claim 1, wherein yield voltage of said diode is less than 3 KV.

5. A fixing apparatus according to claim 1, wherein yield voltage of said diode is no greater than 2 KV.

6. A fixing apparatus according to claim 1, wherein said fixing member is an endless belt.

7. A fixing apparatus according to claim 1, further comprising a second diode connected to said pressure conveying member.

8. A fixing apparatus according to claim 7, wherein said second diode generates a voltage of a polarity reverse to the polarity of the non-fixed image without generating a voltage of the same polarity therewith.

9. A fixing apparatus, comprising:

a fixing member contacting a non-fixed toner image having an electrical charge;

a pressure member having a voltage produced primarily by frictional contact, said pressure member pinching and feeding a supporting material bearing the non-fixed toner image thereon, cooperating with said fixing member to thereby fix the non-fixed toner image on the supporting material; and a diode means connected between a ground and said pressure member for maintaining the voltage produced by the frictional contact of said pressure member at a polarity reverse to the polarity of the non-fixed image without generating a voltage having the same polarity therewith.

10. A fixing apparatus according to claim 9, wherein electrostatic capacity of said diode is no greater than 100 pF.

11. A fixing apparatus according to claim 9, wherein yield voltage of said diode is at least 50 V.

12. A fixing apparatus according to claim 9, wherein yield voltage of said diode is less than 3 KV.

13. A fixing apparatus according to claim 9, wherein yield voltage of said diode is no greater than 2 KV.

14. A fixing apparatus according to claim 9, wherein said pressure member has a roller like configuration.

15. A fixing apparatus according to claim 9, wherein resistance of the pressure member is $10^{10}$–$10^{12}$ Ω.

16. An image forming apparatus comprising:

an image bearing member bearing a non-fixed toner image having an electrical charge;

transfer charger means for electrostatically transferring a non-fixed toner image on said image bearing member onto a supporting material;

a conveying member for conveying the supporting material and having a voltage produced primarily by frictional contact; and a diode means connected between a ground and a surface of said conveying member, said diode for maintaining the voltage produced by the frictional contact of said conveying member at a polarity same as the transfer charge without generating voltage of a polarity reverse thereto.

17. An image forming apparatus according to claim 16, wherein said transfer charger means has a transfer rotary member contacting with said image bearing member.

18. An image forming apparatus according to claim 16, wherein said conveying members comprise fixing and pressure conveyer members and further comprising a second diode means connected to the pressure conveying member.

19. An image forming apparatus according to claim 18, wherein said second diode means generates a voltage of polarity reverse to the transfer charge without generating the voltage of polarity same therewith.

20. An image forming apparatus according to claim 16, wherein electrostatic capacity of said diode is no greater than 100 pF.

21. An image forming apparatus according to claim 16, wherein yield voltage of said diode is at least 50 V.

22. An image forming apparatus according to claim 16, wherein yield voltage of said diode is less than 3 KV.

23. An image forming apparatus according to claim 16, wherein yield voltage of said diode is no greater than 2 KV.

24. An image forming apparatus according to claim 16, wherein at least one of said conveying members is an endless belt.

* * * * *

UNITED STATES PATENT AND TRADEMARK OFFICE

CERTIFICATE OF CORRECTION

PATENT NO. : 5,253,024

DATED : October 12, 1993

INVENTOR(S) : KOICHI OKUDA, ET AL.

It is certified that error appears in the above-indentified patent and that said Letters Patent is hereby corrected as shown below:

COLUMN 3
Line 28, "harogen" should read --halogen--.

COLUMN 4
Line 4, "images" should read --image--.

COLUMN 5
Line 48, "having" should read --has--.

COLUMN 6
Line 8, "harogen" should read --halogen--.

COLUMN 7
Line 24, "is" should read --are--.

COLUMN 10
Line 23, "earth" should read --ground--;
Line 56, "was" should read --were--.

UNITED STATES PATENT AND TRADEMARK OFFICE

CERTIFICATE OF CORRECTION

PATENT NO. : 5,253,024

DATED : October 12, 1993

INVENTOR(S) : KOICHI OKUDA, ET AL.

It is certified that error appears in the above-indentified patent and that said Letters Patent is hereby corrected as shown below:

COLUMN 11

Line 64, "as" should be deleted.

COLUMN 12

Line 20, "hav -" should read --has--;
Line 21, "ing" should be deleted;
Line 36, "be" should be deleted;
Line 40, "hav-" should read --has--;
Line 41, "ing" should be deleted;
Line 48, "earth" should be deleted; and
Line 54, "connected to the earth" should read --grounded--.

COLUMN [57] ABSTRACT

Line 8, "prevent" should read --prevents--.

Signed and Sealed this

Seventh Day of June, 1994

Bruce Lehman

*Attest:*

BRUCE LEHMAN

*Attesting Officer*

*Commissioner of Patents and Trademarks*